US005706972A

United States Patent [19]

Sousa

[11] Patent Number: 5,706,972

[45] Date of Patent: Jan. 13, 1998

[54] SELF-CLOSING BEVERAGE LID

[76] Inventor: Nuno J. Sousa, 26 Andrew Ave., Taunton, Mass. 02780

[21] Appl. No.: 586,202

[22] Filed: Jan. 16, 1996

[51] Int. Cl.[6] ..... A47G 19/22; B65D 3/02

[52] U.S. Cl. ..... 220/714; 220/254

[58] Field of Search ..... 220/714, 715, 220/254; 222/484, 517, 556

[56] References Cited

U.S. PATENT DOCUMENTS

| | | | |
|---|---|---|---|
| 3,015,411 | 1/1962 | Smith | 220/714 |
| 3,208,629 | 9/1965 | Beeson | 220/714 |
| 3,338,467 | 8/1967 | Albert | 220/714 |
| 3,938,690 | 2/1976 | Butler | 220/714 |
| 4,190,174 | 2/1980 | Haimowitz | 220/714 |
| 5,477,980 | 12/1995 | Chaffin | 220/714 |

FOREIGN PATENT DOCUMENTS

| | | | |
|---|---|---|---|
| 93/00031 | 1/1993 | WIPO | 220/714 |

*Primary Examiner*—Joseph M. Moy

[57] ABSTRACT

A self-closing beverage lid including a lid portion adapted for sealable coupling with an open top end of a container. The lid portion has an opening therethrough adjacent to a peripheral edge thereof. A spring biased sealing member is selectively disposed over the opening within an interior of the lid portion.

1 Claim, 3 Drawing Sheets

FIG 5
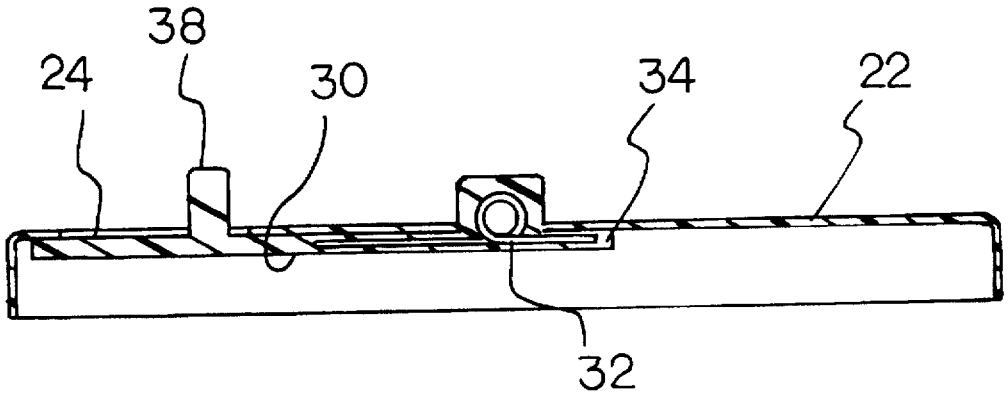
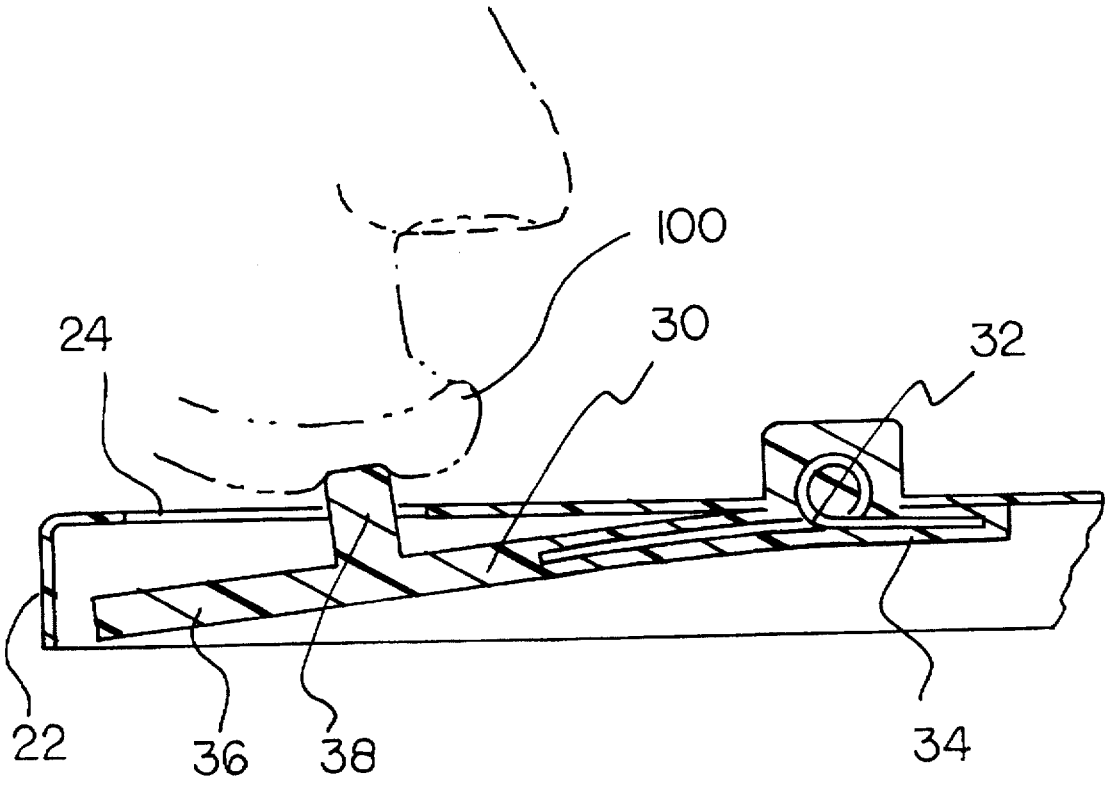
FIG 6

SELF-CLOSING BEVERAGE LID

BACKGROUND OF THE INVENTION

1. Field of the Invention

The present invention relates to a self-closing beverage lid and more particularly pertains to automatically closing and opening access to a beverage with a self-closing beverage lid.

2. Description of the Prior Art

The use of container lids is known in the prior art. More specifically, container lids heretofore devised and utilized for the purpose of preventing spills are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,143,248 to Sawatsky discloses a recloseable coffee cup cover.

U.S. Pat. No. 5,244,113 to Stymiest discloses a container lid assembly.

U.S. Pat. No. 5,183,172 to Boller discloses a drink through container lid.

U.S. Pat. No. 5,065,880 to Horner discloses a splash resistant cup lid.

U.S. Pat. No. 4,915,250 to Hayes, Jr. discloses a non-vented spill-proof lid.

U.S. Pat. No. 4,795,052 to Hayes, Jr. discloses a spill-proof lid.

While these devices fulfill their respective, particular objective and requirements, the aforementioned patents do not describe a self-closing beverage lid for automatically closing and opening access to a beverage.

In this respect, the self-closing beverage lid according to the present invention substantially departs from the conventional concepts and designs of the prior art, and in doing so provides an apparatus primarily developed for the purpose of automatically closing and opening access to a beverage.

Therefore, it can be appreciated that there exists a continuing need for new and improved self-closing beverage lid which can be used for automatically closing and opening access to a beverage. In this regard, the present invention substantially fulfills this need.

SUMMARY OF THE INVENTION

In the view of the foregoing disadvantages inherent in the known types of container lids now present in the prior art, the present invention provides an improved self-closing beverage lid. As such, the general purpose of the present invention, which will be described subsequently in greater detail, is to provide a new and improved self-closing beverage lid and method which has all the advantages of the prior art and none of the disadvantages.

To attain this, the present invention essentially comprises a cylindrical container having an open top end, a closed lower end, and a surrounding side wall therebetween. A lid portion is adapted for sealable coupling with the open top end of the cylindrical container. The lid portion has an opening therethrough adjacent to a peripheral edge thereof. The opening has a generally rectangular configuration. The device includes a spring biased sealing member comprised of a flexible main portion with a spring disposed within an end portion thereof. The spring biases the sealing member to a closed orientation. The end portion is integral with an interior surface of the lid portion. The main portion has an opposed end portion selectively disposed over the opening within the lid portion. The opposed end portion has a lip engagement tab extending upwardly therefrom. The lip engagement tab extends outwardly of the opening of the lid portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved self-closing beverage lid which has all the advantages of the prior art container lids and none of the disadvantages.

It is another object of the present invention to provide a new and improved self-closing beverage lid which may be easily and efficiently manufactured and marketed.

It is a further object of the present invention to provide a new and improved self-closing beverage lid which is of durable and reliable construction.

An even further object of the present invention is to provide a new and improved self-closing beverage lid which is susceptible of a low cost of manufacture with regard to both materials and labor, and which accordingly is then susceptible of low prices of sale to the consuming public, thereby making such a self-closing beverage lid economically available to the buying public.

Still yet another object of the present invention is to provide a new and improved self-closing beverage lid which provides in the apparatuses and methods of the prior art some of the advantages thereof, while simultaneously overcoming some of the disadvantages normally associated therewith.

Even still another object of the present invention is to provide a new and improved self-closing beverage lid for automatically closing and opening access to a beverage.

Lastly, it is an object of the present invention to provide a new and improved self-closing beverage lid including a lid portion adapted for sealable coupling with an open top end of a container. The lid portion has an opening therethrough adjacent to a peripheral edge thereof. A spring biased sealing member is selectively disposed over the opening within an interior of the lid portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross-sectional view as taken along line 5—5 of FIG. 3.

FIG. 6 is a side elevation view of the lid shown in cross-section while in use.

The same reference numerals refer to the same parts through the various Figures.

DESCRIPTION OF THE PREFERRED EMBODIMENT

Figure 1:
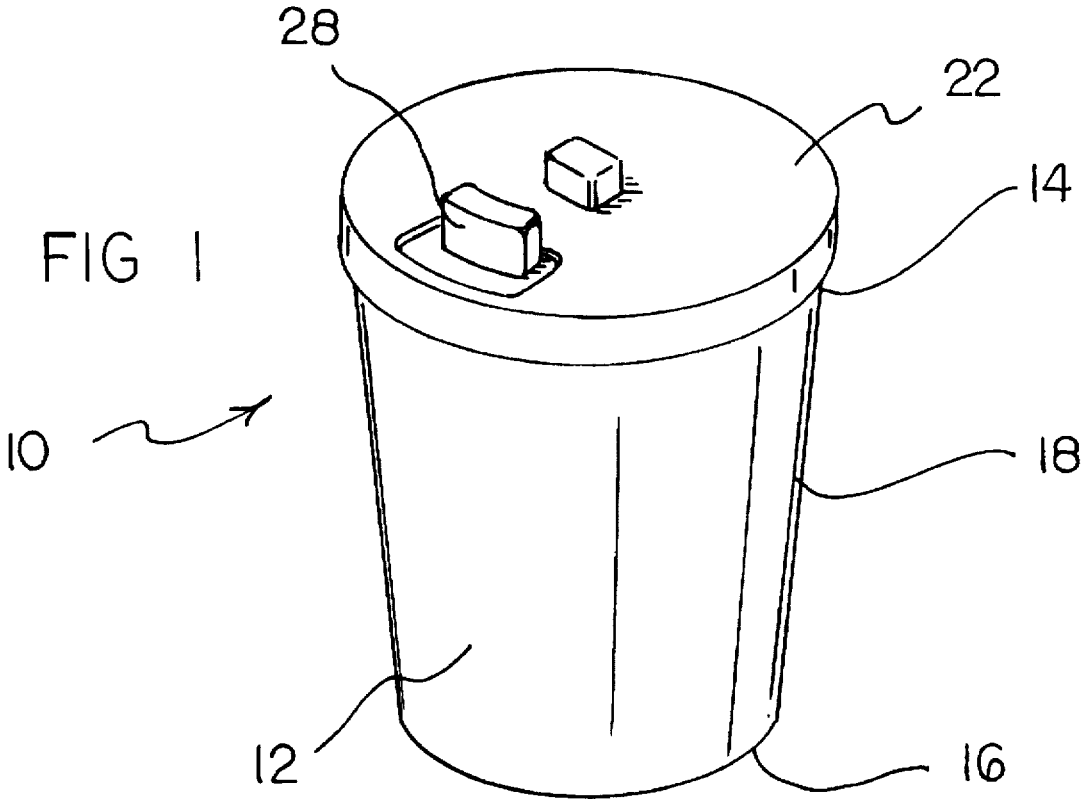
FIG. 1 is a perspective view of the preferred embodiment of the self-closing beverage lid constructed in accordance with the principles of the present invention.
Figure 2:
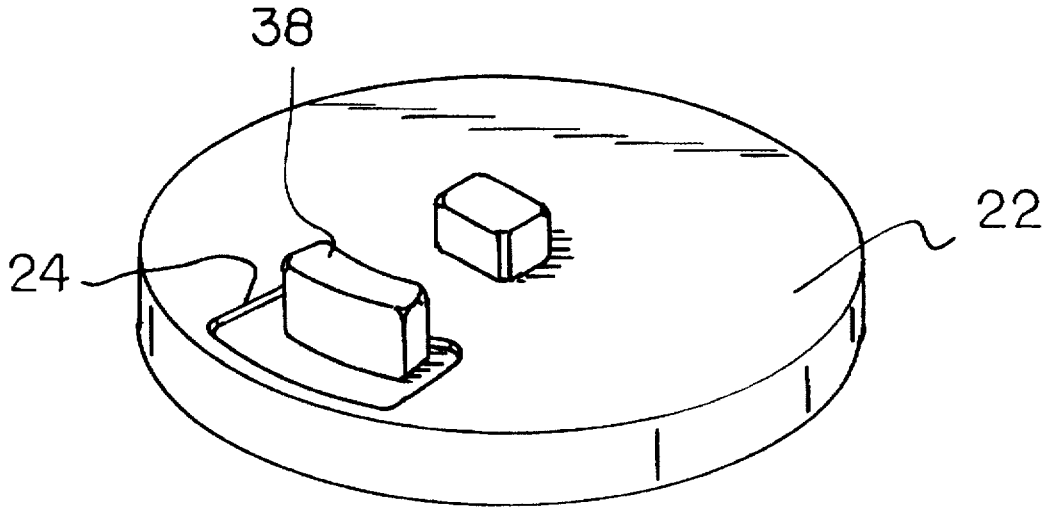
FIG. 2 is a perspective view of the lid of the present invention.
Figure 3:
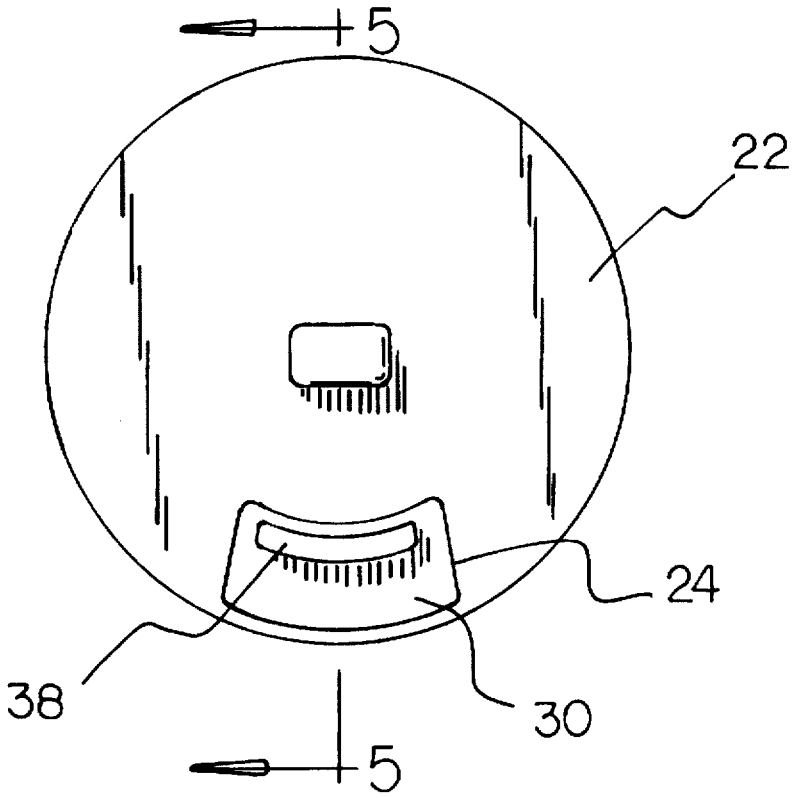
FIG. 3 is a plan view of the lid of the present invention.
Figure 4:
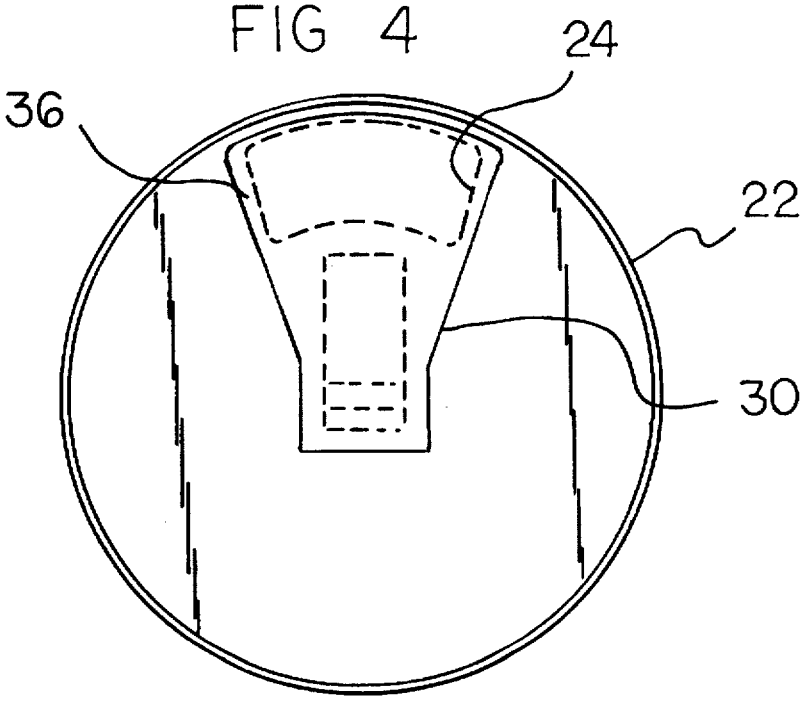
FIG. 4 is a bottom view of the lid of the present invention.

With reference now to the drawings, and in particular, to FIGS. 1–6 thereof, the preferred embodiment of the new and improved self-closing beverage lid embodying the principles and concepts of the present invention and generally designated by the reference number 10 will be described.

Specifically, it will be noted in the various Figures that the device relates to a new and improved self-closing beverage lid for automatically closing and opening access to a beverage. In its broadest context, the device consists of a cylindrical container, a lid portion, and a spring biased sealing member. Such components are individually configured and correlated with respect to each other so as to attain the desired objective.

The device 10 includes a cylindrical container 12 having an open top end 14, a closed lower end 16, and a surrounding side wall 18 therebetween. The container 12 used can be made in any number of sizes corresponding to lids used in the device 10. The preferable construction of the container 12 is an insulated plastic material.

A lid portion 22 is adapted for sealable coupling with the open top end 14 of the cylindrical container 12. The lid portion 22 has an opening 24 therethrough adjacent to a peripheral edge thereof. The opening 24 has a generally rectangular configuration. The lid portion 22 is simply snapped in place on the container 12 once a beverage is poured therein. The lid portion 22 can be made in a variety of sizes to accommodate a variety of different sized containers. The lid portion 22 could also be designed to be used with different styles of containers.

Lastly, the device 10 includes a spring biased sealing member 28 comprised of a flexible main portion 30 with a spring 32 disposed within an end portion 34 thereof. The spring 32 biases the sealing member 28 to a closed orientation. The end portion 34 is integral with an interior surface of the lid portion 22. The main portion 30 has an opposed end portion 36 selectively disposed over the opening 24 within the lid portion 22. The opposed end portion 36 has a lip engagement tab 38 extending upwardly therefrom. The lip engagement tab 38 extends outwardly of the opening 24 of the lid portion 22. Once a user decides that they want to take a sip of the beverage contained within the container, they press their upper lip 100 over the lip engagement tab 38 which will cause the main portion 30 to lower thereby exposing the opening 24 in the lid portion to allow the beverage to exit outwardly thereof into the user's mouth. Once finishing their drink, the user removes their upper lip 100 from the lip engagement tab 38 which will allow the spring 32 to return the main portion 30 to the closed orientation which will prevent the beverage from pouring out of the opening 24. This feature not only will control the amount of beverage consumed at one time as well as preventing the unwanted spillage of the beverage. Such spillage, possibly of a hot beverage, will cause damage to a user's skin as well as their clothes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A self-closing beverage lid for automatically closing and opening access to a beverage can comprising, in combination:

a cylindrical container having an open top end, a closed lower end, and a surrounding side wall therebetween;

a lid portion with a planer surface extending to the periphery thereof, the lid portion adapted for sealable coupling with the open top of the cylindrical container, the lid portion having an opening therethrough adjacent to a peripheral edge thereof, the opening having a generally rectangular configuration, the opening being less than ⅕ of an area of the lid portion;

a spring biased sealing member comprised of a flexible main portion having a metal coil spring disposed within an end portion thereof, the spring biasing the sealing member to a closed orientation, the end portion integral with an interior surface of the lid portion, the main portion having an opposed end portion selectively disposed over the opening within the lid portion, the opposed end portion having a lip engagement tab extending upwardly therefrom, the lip engagement tab extending outwardly of the opening of the lid portion to a position above the entire lid portion.

* * * * *